United States Patent [19]

Gardikas et al.

[11] 4,428,508

[45] Jan. 31, 1984

[54] ATHLETES WATER BOTTLE

[76] Inventors: Paul T. Gardikas, 7241 Sun Breeze Dr., Huntington Beach, Calif. 92647; Daniel W. Bailey, 2020 Tevis Ave., Long Beach, Calif. 90815

[21] Appl. No.: 280,323

[22] Filed: Jul. 6, 1981

[51] Int. Cl.[3] ..... B67B 5/03; B67D 5/32

[52] U.S. Cl. ..... 222/153; 222/211

[58] Field of Search ..... 222/211, 215, 153; 215/215, 219

[56] References Cited

U.S. PATENT DOCUMENTS

| | | | |
|---|---|---|---|
| 1,609,674 | 12/1926 | Tefft | 222/215 |
| 2,783,919 | 3/1957 | Ansell | 222/211 |
| 3,097,756 | 7/1965 | Dorsey | 215/215 |
| 3,394,830 | 7/1968 | Schiauo | 215/215 X |
| 3,710,970 | 1/1973 | Elfline | 215/215 |

FOREIGN PATENT DOCUMENTS

| | | | |
|---|---|---|---|
| 1366230 | 9/1974 | United Kingdom | 215/215 |

*Primary Examiner*—Charles A. Marmor

*Attorney, Agent, or Firm*—William C. Babcock

[57] ABSTRACT

An elongate container for drinking water formed from a resilient laterally deformable polymerized resin. The container has a wide mouth neck that has first coarse threads on the exterior thereof that are threadedly and frictionally engaged by second coarse threads on the interior of the combined closure and drinking water dispensing assembly. The assembly has a water dispensing tube projecting outwardly therefrom through which a jet of drinking water is discharged when the container is squeezed by an athlete. The assembly rotatably supports an inverted cup shaped guard, which guard is free to rotate thereon. Visual insignia are provided on the guard to axially align first and second pairs of openings in the closure and guard to permit an elongate rigid member to be extended therethrough, and used to twist the closure assembly into binding frictional engagement with the neck. The elongate member when removed from the openings allows the guard to rotate freely on the closure. Rotation of the guard by an athlete will have no effect on loosening the combined closure and water dispensing assembly from the container to allow the athletes to drink directly from the neck of the container which is unsanitary.

3 Claims, 6 Drawing Figures

ATHLETES WATER BOTTLE

BACKGROUND OF THE INVENTION

1. Field of the Invention

The invention relates generally to containers for drinking water for athletes. The container is of such structure that athletes can use the same to obtain drinking water only in the form of a jet that discharges from a container, with athletes being precluded from using the container in an unsanitary manner by drinking from the neck of the container.

2. Description of the Prior Art

In strenuous team sports it is common practice to provide a number of containers that hold drinking water. Although various devices have been proposed and used to preclude athletes drinking water directly from the containers, athletes have shown ingenuity in removing such devices from the container. Drinking of water from a single container by a number of athletes is unsanitary and can lead to the spread of a disease.

A major object of the present invention is to supply a container for drinking water that has a neck on which a combined closure and water dispensing assembly is screw mounted by an elongate member substantially longer than the tip of a shoe lace, and the assembly when so mounted rotatably supporting a guard ring that freely rotates thereon to prevent the unauthorized removal of the combined closure and water dispensing assembly by an athlete.

Another object of the invention is to furnish a drinking water dispenser for athletes that can only have water discharged therefrom in the form of a jet.

A still further object of the invention is to provide a water dispenser for athletes in which the lips of the athletes do not touch the same when the invention is used by the athletes for drinking purposes.

Yet another object of the invention is to provide a closure assembly for a medicine bottle or the like, to prevent a child from having unauthorized access to the contents of the bottle.

These and other object of the invention will become apparent from the following description thereof.

SUMMARY OF THE INVENTION

The sanitary athletes drinking water bottle of the present invention includes an elongate deformable container, preferably from a commercially available polymerized resin that has a wide mouthed neck. First coarse threads are defined on the exterior surface of the neck.

A generally cylindrical closure is provided that has second coarse threads on the interior thereof that may removably and wedgingly engage the first coarse threads when rotated in an appropriate direction relative thereto. The closure includes a flat web that has a water dispensing tube extending upwardly and downwardly from the center thereof, and supported by the web. First and second ribs extend upwardly from the web and cooperate to define a slot therebetween. The web has a visable insignia in an off centered position thereon.

The closure has a rotatable guard permanently mounted thereon, which guard has a centered opening therein through which the water dispensing tube extends upwardly. The guard includes a cylindrical sidewall that has a transverse opening therein that is axially aligned with an oppositely disposed internal recess formed in the sidewall.

An aperture is formed in the upper portion of the guard. When the guard is rotated to a position where the insignia is visable therethrough, the opening and recess are axially aligned with the slot in the closure. An elongate rigid rod may now be extended transversely through the opening, the slot to engage the recess. The rod includes a projecting handle. By using the rod to concurrently rotate the guard and closure in an appropriate direction, the first and second threads are forced into wedging engagement. The rod is now removed from the guard and closure.

An athlete cannot remove the closure from the container without the use of the rod, which of course will not be furnished to him. Rotation of the guard by an athlete will have no effect on loosening the closure, as the guard will simply rotate relative thereto. The athlete to obtain water from the container must squeeze the same transversely to force the water upwardly through the dispensing tube, which tube preferably terminates on the upper end in a funnel to prevent lip engagement of an athlete with the water dispensing tube.

The assembly above described may be used on a medicine bottle or the like to prevent a child from opening the same, when the invention is so used, the water dispensing tube is omitted.

BRIEF DESCRIPTION OF THE DRAWING

FIG. 6 is a perspective view of the invention with the water dispensing tube omitted to serve as a safety closure on a medicine bottle or the like.

DESCRIPTION OF THE PREFERRED EMBODIMENT

Figure 1:
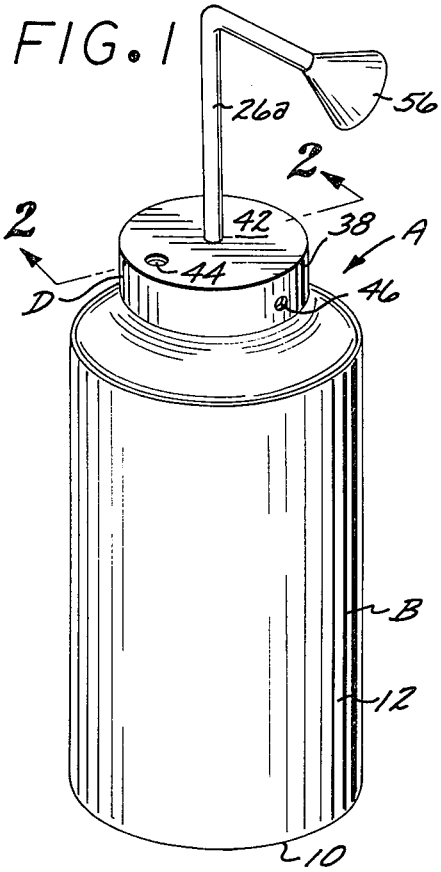
FIG. 1 is a perspective view of the sanitary athletes drinking water bottle.

The combined closure and drinking water dispensing assembly A for use by an athlete is shown mounted on an elongate transversely deformable container B for water as shown in FIG. 1, which container is formed from a commerically available polymerized resin suitable for this purpose.

Figure 2:
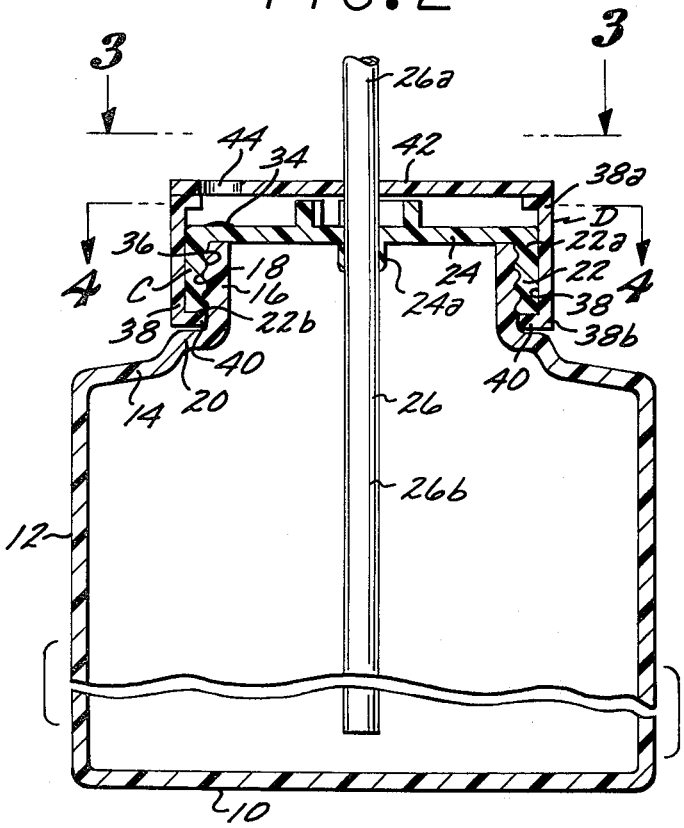
FIG. 2 is a longitudinal cross sectional view of the invention taken on the line 2—2 of FIG. 1.
Figure 3:
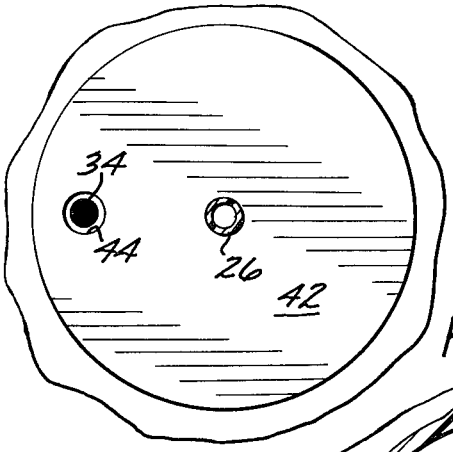
FIG. 3 is a top plan view of the invention taken on the line 3—3 of FIG. 2.

Container B includes a bottom 10, cylindrical sidewall 12, top 14 and a neck 16 that has coarse first threads 18 formed on the exterior surface thereof as shown in FIG. 2. The neck 16 defines a wide mouth. A circular body shoulder is formed on container B at the junction of the top 14 and neck 16.

The closure C as may best be seen in FIG. 2 includes a first cylindrical sidewall 22 that has first and second circumferential edges **22*a* and 22*b*. The first circumferential edge 22*a* merges into flat transverse web 24 that has a centered opening therein through which a water dispensing tube 26 extends in a longitudinal position relative to the container B. The web 24 is sealingly secured to the tube by an enveloping portion 24*a* as shown in FIG. 2. Tube 26 includes an upper portion 26*a*** and a lower portion 26b that extends downwardly in container B to terminate adjacent bottom 10.

Figure 4:
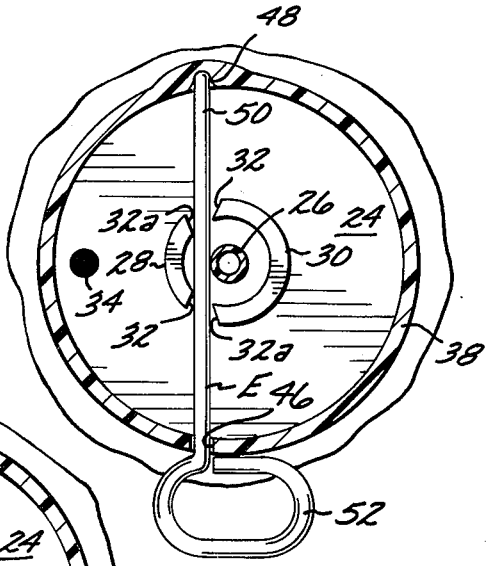
FIG. 4 is a transverse cross sectional view of the invention taken on the line 4—4 of FIG. 2.
Figure 5:
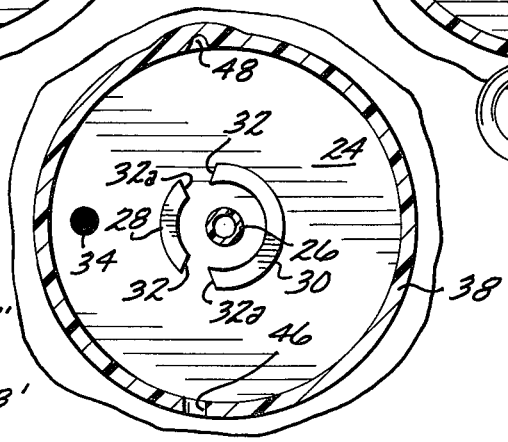
FIG. 5 is a top plan view of the invention removably engaged by an elongate rod to either tighten the closure on the container or loosen it therefrom.

First and second ribs 28 and 30 extends upwardly from web 24 as shown in FIGS. 2, 4 and 5 that define axially aligned slots 32 therebetween, which slots have tapered entrances 32a, although a pair of slots 32 are illustrated in the drawing a single elongate slot could be defined by the ribs if desired.

The web 24 as may be seen in FIGS. 2 and 5 has an off centered insignia defined thereon. The first cylindrical sidewall 22 has second coarse threads defined on the interior surface thereof that by rotation in an appropriate direction may removably and wedgingly engage the first coarse threads 18 as shown in FIG. 2.

A guard D is shown in FIGS. 1 and 2 that envelops the closure C. Guard D includes a second cylindrical sidewall 38 that slidable and rotatably engages the first sidewall 22. The second cylindrical sidewall 38 has first and second circumferential edges 38a and 38b best seen in FIG. 2. The second circumferential edge 38b has a circular lip 40 extending inwardly therefrom and under second circumferential edge 22b of first cylindrical sidewall 22.

Guard D has a flat circular top 42 bonded to the upper circumferential edge 38a by adhesives or the like (not shown), and the top including a circular downwardly extending rib situated on the interior of the second cylindrical side wall 38. An aperture 44 is formed in an off centered position on top 42.

Second cylindrical sidewall 38 has a transverse opening 46 thereon that is axially aligned with an internal recess 48 formed in second cylindrical sidewall 38. When guard D is rotated to a position where insignia 34 is visible through aperture 44, opening 46, slots 32 and recess 48 are axially aligned.

A rotating device E is provided that is separate from the closure assembly. Rotating device E includes an elongate rigid rod 50 that may be extended through opening 46 and slots 32 to engage recess 48 as shown in FIG. 5 when aperture 44 is vertically aligned with insignia 34. Rod 50 has handle 52 on the end thereof as shown in FIG. 5.

When the rotating device is disposed as shown in FIG. 5 the guard and handle may be used to rotate the guard D and closure C to force the first and second threads 18 and 36 into wedging engagement. The rod 50 is now removed from the assembly A. The water dispensing tube portion 26a preferably terminates in a funnel shaped member 56 to prevent an athlete having lip contact with the water dispensing tube portion 26a.

From the above description it will be apparent that an athlete without the rotating device E cannot remove the closure C from the neck 16 to drink directly from the latter. Accordingly, the athlete must laterally squeeze the container B to dispense water through tube 26, and cross infection of diseases between athletes is avoided from the drinking of water.

Figure 6:
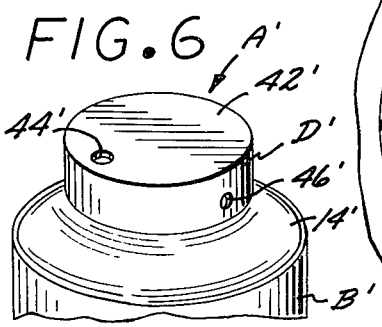

A modification A' of the invention is shown in FIG. 6 that eliminates the dispensing tube 26. In this form of the invention there is no central opening in web 24. The modification A' of the invention operates in the same manner as form A, and serves as a safety closure to prevent children having unauthorized access to the contents of a medicine bottle or the like. Elements in modification A' that are common to the form A are identified by the numerals and letters previously used but with primes added thereto.

The use and operation of the invention has been described previously in detail and need not be repeated.

What is claimed is:

1. A sanitary athletes drinking water bottle that includes:

a. an elongate container for holding said drinking water and defined by a resilient polymerized resin, said container including a bottom, a cylindrical sidewall, a top, and a wide mouthed neck projecting upwardly from said top, said neck having coarse first threads defined on the exterior surface thereof and said neck and top at their junction defining a circular body shoulder;

b. a combined closure and drinking water dispensing assembly that includes a first cylindrical sidewall that has first and second circumferential edges and coarse second threads on the interior thereof, said second coarse threads on the interior of said first cylindrical sidewall threadedly and bindingly engaging said first coarse threads when rotated relative thereto in a first direction, a transverse web that merges into said first circumferential edge, an elongate water dispensing tube supported in a centered position by said web and having a first portion that extends downwardly in said container to terminate adjacent said bottom, and a second portion that extends upwardly a substantial position above said top, a visual insignia defined on the upper surface of said web, and transverse slot defining means that extend upwardly from said web and to one side of said tube;

c. a guard that includes a second cylindrical sidewall that rotatably engages said first sidewall, said second sidewall having first and second circumferential edges, a circular lip that projects inwardly from said second circumferential edge of said second sidewall under said second circumferential edge of said first sidewall and slightly above said body shoulder to act as a stop to prevent forceful removal of the guard from said combined closure and drinking water assembly by an athlete, a transverse top that merges into said first circumferential edge of said second cylindrical sidewall, said top having a centered opening therein through which said water dispensing tube extends upwardly, a transverse opening in said second sidewall that may be axially aligned with said slot defining means and a recess on the interior of said second sidewall, and an aperture in said top which when said insignia is visable therethrough visually indicates said opening, recess and slot defining means are axially aligned; and d. a rigid elongate member that may be removably inserted through said transverse opening, slot defining means to engage said recess to twist said combined closure and drinking water assembly in said first direction to force said first and second coarse threads into frictional wedging engagement, with said elongate member then being removed, and an athlete thereafter only able to dispense water from said tube as a jet into his mouth by laterally squeezing said cylindrical sidewall, as rotation of said guard will have no effect in loosening said combined closure and drinking assembly to permit same to be removed from said neck to permit the athlete to drink therefrom.

2. A sanitary athletes drinking water bottle as defined in claim 1 that in addition includes:

e. a funnel shaped member on the outer extremity of said elongate water dispensing tube that prevents the lips of an athlete contacting said dispensing tube.

3. A sanitary athletes drinking water bottle as defined in claim 1 in which said elongate water dispensing tube is of generally L shape.

* * * * *